United States Patent [19]

Martin

[11] 4,276,185

[45] Jun. 30, 1981

[54] METHODS AND COMPOSITIONS FOR REMOVING DEPOSITS CONTAINING IRON SULFIDE FROM SURFACES COMPRISING BASIC AQUEOUS SOLUTIONS OF PARTICULAR CHELATING AGENTS

[75] Inventor: Larry D. Martin, Duncan, Okla.

[73] Assignee: Halliburton Company, Duncan, Okla.

[21] Appl. No.: 118,346

[22] Filed: Feb. 4, 1980

[51] Int. Cl.[3] ..... C23G 1/14; C23G 1/18; C11D 7/32; C11D 7/26

[52] U.S. Cl. ..... 252/87; 134/2; 134/3; 252/8.55 B; 252/82; 252/142; 252/148; 252/149; 252/151; 252/156; 252/158

[58] Field of Search ..... 252/82, 87, 149, 148, 252/151, 8.55 B, 8.55 E, 156, 158, 142; 134/3, 2

[56] References Cited

U.S. PATENT DOCUMENTS

| | | | |
|---|---|---|---|
| 2,403,153 | 7/1946 | Saukaitis | 252/149 |
| 2,472,400 | 6/1949 | Bond et al. | 252/8.55 E |
| 3,033,214 | 5/1962 | Bersworth et al. | 134/13 |
| 3,066,097 | 11/1962 | Jones | 252/8.55 E |
| 3,308,065 | 3/1967 | Lesinski | 252/82 |
| 3,353,995 | 11/1967 | Teumac | 134/3 |
| 3,794,523 | 2/1974 | Thompson | 252/87 X |
| 4,011,097 | 3/1977 | Sharp | 134/3 |
| 4,025,359 | 5/1977 | Connelly | 252/151 X |
| 4,032,360 | 6/1977 | Sharp | 134/3 |
| 4,108,681 | 8/1978 | Lawson et al. | 252/82 X |

*Primary Examiner*—Harris A. Pitlick

*Attorney, Agent, or Firm*—Thomas R. Weaver; John H. Tregoning; C. Clark Dougherty, Jr.

[57] ABSTRACT

Methods and compositions for removing deposits containing iron sulfide from surfaces with minimal hydrogen sulfide evolution. A composition comprised of a basic aqueous solution of a chelating agent selected from the group consisting of citric acid, oxalic acid, alkylene polyamine polyacetic acids and mixtures of such chelating agents having a pH in the range of from about 8 to about 10 is brought into contact with the deposits for a period of time sufficient for the deposits to be dissolved therein.

47 Claims, No Drawings

METHODS AND COMPOSITIONS FOR REMOVING DEPOSITS CONTAINING IRON SULFIDE FROM SURFACES COMPRISING BASIC AQUEOUS SOLUTIONS OF PARTICULAR CHELATING AGENTS

Iron sulfide (FeS), also known as troilite, by itself or in combination with organic materials such as asphalt or tar is often deposited on metal surfaces in process and refinery equipment such as heat exchangers, power-formers, etc., particularly where sour fluids, i.e., fluids containing hydrogen sulfide are processed. While troilite deposits are readily dissolved in common acidic solvents such as hydrochloric acid and sulfuric acid, as the troilite dissolves in such solvents hydrogen sulfide is evolved creating a severe occupational and environmental hazard. Further, when the deposits containing iron sulfide also contain organic materials such as asphalt or tar, penetration and rapid dissolution of the deposits is difficult.

By the present invention improved methods and compositions for dissolving deposits containing iron sulfide, including those also containing organic materials, are provided which bring about the efficient removal of the deposits with little or no evolution of hydrogen sulfide.

A composition of the present invention for removing deposits containing iron sulfide from surfaces with minimal hydrogen sulfide evolution is comprised of a basic aqueous solution of a chelating agent having a pH in the range of from about 8 to about 10, and most preferably, a pH of 9 or above. The chelating agents which are useful in accordance with the present invention are those chelating acids which in an aqueous solution are capable of dissolving iron sulfide and tightly binding ions in the presence of sulfide ions. Particularly suitable such chelating acids for use in accordance with the present invention are citric acid, oxalic acid, nitrilotriacetic acid, alkylenepolyamine polyacetic acids and mixtures of such acids. Examples of the alkylenepolyamine polyacetic acids are ethylenediaminetetraacetic acid (EDTA), diethylenetriaminepentaacetic acid, N-2-hydroxyethylethylenediaminetriacetic acid, propylene-1,2-diamine tetracetic acid, propylene-1,3-diaminetetracetic acid, the isometric butylenediaminetetracetic acids, etc., and mixtures of such acids. Of these, ethylenediaminetetraacetic acid is preferred. The most preferred chelating acids for use in accordance with this invention are nitrilotriacetic acid and ethylenediaminetetraacetic acid.

In preparing the above-described composition, the chelating acid can be combined directly with water to form a solution thereof and the pH subsequently adjusted with ammonia or a base (other than alkali metal bases) to the desired level. Most preferably, the ammonium salts of the particular chelating acid or acids used are combined with water to form a basic solution thereof, and if the pH of the resulting solution is below the desired level, additional ammonia is combined with the solution. In preparing the most preferred composition for dissolving iron sulfide described above, tetraammoniumethylenediaminetetraacetate is combined with water to form a solution thereof, which solution has a pH of about 9.4 without combining additional basic materials therewith.

The chelating acid or acids used are preferably present in the composition in an amount in the range of from about 2% to about 10% by weight of the composition.

When nitrilotriacetic acid or ethylenediaminetetraacetic acid or mixtures of such acids are used, they are preferably present in the composition in a total amount in the range of from about 4% to about 8% by weight of the composition, with 4% being the most preferred.

When the deposits being removed are contained on metal surfaces, a corrosion inhibitor such as a mixture of an alkylpyridine and dibutylthiourea is preferably included in the composition. Preferably, such corrosion inhibitor is present in the composition in an amount in the range of from about 0.05% to about 0.6% by volume of the composition, most preferably in the range of from about 0.1% to about 0.2% by volume.

Another composition of the present invention for removing deposits containing organic materials and iron sulfide is an emulsified composition comprised of a basic aqueous solution having a pH of from about 8 to about 10 of a chelating agent selected from the group consisting of citric acid, oxalic acid, nitrilotriacetic acid, alkylenepolyamine polyacetic acids and mixtures of such acids, emulsified with a liquid hydrocarbon solvent for the organic materials in the deposits. While a variety of liquid hydrocarbon solvents can be utilized, ortho-dichlorobenzene, xylene and heavy aromatic naphtha are preferred with heavy aromatic naphtha having a flash point above about 200° F. being the most preferred.

Various emulsifiers can be utilized in the composition to provide a rapidly formed stable emulsion. Examples of preferred such emulsifiers are oxyalkylated phenols and the carboxylated salts thereof such as nonylphenol ethoxylated with four moles of ethylene oxide presented by the following formula:

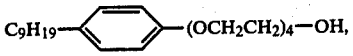

and castor oil ethoxylated with 40 moles of ethylene oxide. The most preferred emulsifier for use in accordance with this invention is castor oil ethoxylated with 40 moles of ethylene oxide.

While the various chelating acids described above can be used, the preferred chelating acids for use in the emulsified composition are nitrilotriacetic acid and ethylenediaminetetraacetic acid, with ethylenediaminetetraacetic acid being the most preferred. The chelating acid or acids are preferably present in the composition in an amount in the range of from about 4% to about 8% by weight of the composition. The hydrocarbon solvent used, most preferably heavy aromatic naphtha having a flash point above about 200° F., is preferably present in the composition in an amount of from about 10% to about 50% by volume, with the emulsifier used being present in the composition in an amount in the range of from about 0.1% to about 1.0% by volume of the composition.

When the deposits being removed are contained on metal surfaces, a corrosion inhibitor such as a mixture of an alkylpyridine and dibutylthiourea is preferably included in the composition. Preferably, such corrosion inhibitor is present in the composition in an amount in the range of from about 0.05% to about 0.6% by volume of the composition, most preferably in the range of from about 0.1% to about 0.2% by volume.

In order to increase the rate of dissolution of organic materials by the liquid hydrocarbon solvent used, a coupling agent, preferably benzotriazole is also included in the composition in an amount in the range of from about 0.1% to about 1.0% by weight of the composition.

The most preferred composition of this type is an emulsion comprised of a basic aqueous solution of ethylenediaminetetraacetic acid wherein the acid is present in the composition in an amount of about 4% by weight of the composition, ammonia present in the composition in an amount such that the composition has a pH of about 9, castor oil ethoxylated with 40 moles of ethylene oxide emulsifier present in the composition in an amount of about 0.5% by volume of the composition, heavy aromatic naphtha having a flash point above about 200° F. present in the composition in an amount of about 30% by volume of the composition, a corrosion inhibitor comprised of a mixture of alkylpyridine and dibutylthiourea present in the composition in an amount of about 0.1% by volume of the composition, and benzotriazole coupling agent present in the composition in an amount of about 0.3% by weight of the composition.

In preparing the above described emulsified compositions, the chelating acid or acids used, and most preferably, the ammonium salts of the chelating acid or acids used and the corrosion inhibitor are first combined with water to form a solution thereof. A base (other than alkali metal bases) or additional ammonia are combined with the solution to adjust the pH thereof to the desired level. The emulsifier used is next combined with the liquid hydrocarbon solvent used and the resulting hydrocarbon phase is combined with the aqueous phase and vigorously mixed or circulated to form an emulsion thereof. Once the emulsion has been formed, benzotriazole is combined with the emulsion to form the emulsified deposit removing composition.

In carrying out the methods of this invention for removing deposits containing iron sulfide and/or deposits containing both organic materials and iron sulfide, the deposit removing composition used is brought into contact with the deposits for a period of time sufficient for the deposits to be dissolved therein whereupon the composition containing the dissolved deposits is removed. Preferably, the compositions are heated to a temperature in the range of from about 200° F. to about 300° F. prior to contacting the deposits. The most preferred technique for the removal of such deposits using the compositions of the present invention is to circulate the compositions over the surfaces containing the deposits while heating the compositions to a temperature in the range of from about 200° F. to about 300° F. The circulation is continued for a period of time sufficient for the compositions to dissolve the deposits whereupon the compositions containing the dissolved deposits are removed.

The compositions of the present invention effectively dissolve deposits containing iron sulfide and/or deposits containing organic materials in combination with the iron sulfide, and because of the high pH of the compositions, little or no hydrogen sulfide is evolved while the deposits are dissolved. The emulsified compositions effectively dissolve deposits containing carbonaceous materials, iron sulfides and iron oxides, and consequently, are suitable for cleaning a variety of scales or deposits found in a variety of process equipment. The high pH compositions of this invention are used in a single stage treatment, do not require neutralization after use and are economically disposed of after use. Because the compositions do not contain halogens, their metallurgical compatibility is not restricted.

In order to facilitate a clear understanding of the methods and compositions of the present invention, the following examples are given.

EXAMPLE 1

Compositions of the present invention are prepared by combining the chelants given in Table I below with tap water and adjusting the pH to the desired value by combining ammonia with the resulting solution.

The iron sulfide solids used in the tests are particulated to a size such that they pass through an 80 mesh screen (U.S. Sieve Series) and collect on a 100 mesh screen. In each test, 100 milliliter portions of the composition tested and 3 grams of iron sulfide solids are placed in a sealed autoclave for 24 hours at the temperature given in Table I below. The solids remaining after 24 hours are filtered, washed, dried and weighed and the grams of iron sulfide dissolved by the compositions determined. The results of these tests are given in Table I below.

TABLE I

COMPARISON OF DISSOLUTION OF FeS BY COMPOSITIONS CONTAINING VARIOUS CHELANTS

| Chelant Used | Concentration of Chelant in Aqueous Solution, Wt. Percent | pH of Composition | Temperature Of Composition, °F. | FeS Dissolved, Gms | $H_2S$ Evolution Observations |
|---|---|---|---|---|---|
| ethylenediaminetetraacetic acid (EDTA) | 4 | 9.4 | 200 | 0.28 | Nil |
| EDTA | 4 | 9.4 | 225 | 0.54 | Nil |
| EDTA | 4 | 9.4 | 250 | 0.72 | Nil |
| EDTA | 4 | 9.4 | 275 | 0.81 | Nil |
| EDTA | 4 | 9.4 | 300 | 0.98 | Nil |
| oxalic acid | 4 | 7.0 | 300 | 0.41 | Some Evolved |
| oxalic acid | 4 | 9.0 | 300 | 0.14 | Nil |
| citric acid | 4 | 5.0 | 300 | 0.34 | Some Evolved |
| citric acid | 4 | 7.0 | 300 | 0.34 | Some Evolved |
| citric acid | 4 | 9.0 | 300 | 0.31 | Nil |
| nitrilotriacetic acid (NTA) | 5 | 7.0 | 300 | 0.60 | Some Evolved |
| NTA | 5 | 9.0 | 300 | 0.65 | Nil |

From Table I it can be seen that compositions of this invention containing ethylenediaminetetraacetic acid (EDTA) and nitrilotriacetic acid (NTA) are the most effective of the chelant acids tested in dissolving ferrous sulfide, and that compositions having a pH of about 9 are most effective in dissolving iron sulfide with minimal hydrogen sulfide evolution.

EXAMPLE 2

The procedure set forth in Example 1 above is repeated using various aqueous compositions containing various concentrations of ethylenediaminetetraacetic acid alone and in combination with other chelant acids. 100 milliliter portions of each composition and 5 grams of technical grade ferrous sulfide are used in each test. The results of these tests are set forth in Table II below.

TABLE II

COMPARISON OF DISSOLUTION OF FeS BY COMPOSITIONS CONTAINING ETHYLENEDIAMINETETRAACETIC ACID AND OTHER CHELANT ACIDS

| Quantity of Ethylenediaminetetraacetic Acid in Aqueous Solution, Wt. Percent | Other Chelant Acid in the Aqueous Solution | Quantity of Other Chelant Acid Wt. Percent | pH of Composition | Temperature of Composition °F. | FeS Dissolved Gms. |
|---|---|---|---|---|---|
| 3.89 | — | — | 9 | 300 | 2.35 |
| 3.89 | oxalic acid | 4.0 | 9 | 300 | 2.60 |
| 3.89 | citric acid | 4.0 | 9 | 300 | 2.83 |
| 7.78 | — | — | 9 | 300 | 4.42 |
| 7.78 | citric acid | 4.0 | 9 | 300 | 4.0 |
| 11.67 | oxalic acid | 4.0 | 9 | 300 | 4.37 |

From Table II it can be seen that mixtures of the chelant acids tested and increasing the concentration of chelants in the compositions increases the quantity of iron sulfide dissolved in the compositions.

EXAMPLE 3

An emulsified composition of the present invention is prepared containing the following components:

| Component | Percent |
|---|---|
| Water | |
| Aqueous solution of ethylenediaminetetraacetic acid (40% by weight EDTA) | 58.9% by volume |
| Ethoxylated castor oil (40 moles ethylene oxide) | 10% by volume |
| Dibutylthiourea and an alkylpyridine mixture | 0.1% by volume |
| Heavy aromatic naphtha | 30% by volume |
| Benzotriazole | 0.3% by weight |

The composition is prepared by combining the ethylenediaminetetraacetic acid and corrosion inhibitor with water, combining the emulsifier with the heavy aromatic naphtha and then combining the aqueous phase with the hydrocarbon phase and agitating the mixture to form an emulsion. After the emulsion is formed the benzoltriazole is combined with the emulsion.

A 2-inch specimen of an actual tube from a refinery power-former having a deposit containing organic materials and iron sulfide thereon, i.e., the outside surface of the tube is coated with a layer of deposit 3/16 inch thick and the inside surface is coated with a layer of deposit ⅛ inch thick, is placed into 200 milliliters of the above-described emulsified composition. The composition and specimen are heated to 175° F. and stirred. After 20 hours, the specimen is removed from the composition and visually inspected. The inspection shows that 80% of the deposit is removed from the specimen.

What is claimed is:

1. A method for dissolving iron sulfide deposits with minimal hydrogen sulfide evolution comprising contacting said iron sulfide with a basic aqueous solution of a chelating agent selected from the group consisting of citric acid, oxalic acid, nitrilotriacetic acid, alkylenepolyamine polyacetic acids and mixtures of said chelating agents, said solution having a pH in the range of from about 8 to about 10.

2. The method of claim 1 wherein said chelating agent is present in said solution in an amount in the range of from about 2% to about 10% by weight of said solution.

3. The method of claim 1 wherein said chelating agent is nitrilotriacetic acid present in said solution in an amount in the range of from about 4% to about 8% by weight of said solution.

4. The method of claim 3 wherein said solution contains ammonia in an amount such that said solution has a pH of about 9.

5. The method of claim 1 wherein said chelating agent is ethylenediaminetetraacetic acid present in said solution in an amount in the range of from about 4% to about 8% by weight of said solution.

6. The method of claim 1 wherein said solution is further characterized to include a corrosion inhibitor comprised of a mixture of an alkylpyridine and dibutylthiourea present in said solution in an amount in the range of from about 0.05% to about 0.6% by volume of said solution.

7. A method for dissolving iron sulfide deposits with minimal hydrogen sulfide evolution comprising contacting said iron sulfide with a basic aqueous solution of an alkylenepolyamine polyacetic acid chelating agent, said solution having a pH in the range of from about 8 to about 10.

8. The method of claim 7 wherein said chelating agent is ethylenediaminetetraacetic acid and said solution contains ammonia in an amount such that said solution has a pH of about 9.

9. The method of claim 8 wherein said ethylenediaminetetraacetic acid is present in said solution in an amount in the range of from about 4% to about 8% by weight of said solution.

10. The method of claim 9 wherein said solution is further characterized to include a corrosion inhibitor comprised of a mixture of an alkylpyridine and dibutylthiourea present in said solution in an amount in the range of from about 0.1% to about 0.3% by volume of said solution.

11. A method for removing deposits containing iron sulfide from surfaces with minimal hydrogen sulfide evolution comprising contacting said deposits with a composition consisting essentially of:

water;

a chelating acid selected from the group consisting of nitrioltriacetic acid and an alkylenepolyamine polyacetic acid present in said composition in an amount in the range of from about 4% to about 8% by weight of said composition; and ammonia present in said composition in an amount such that the pH of said composition is in the range of from about 8 to about 10.

12. The method of claim 11 wherein said alkylenepolyamine polyacetic acid is ethylenediaminetetraacetic acid present in said composition in an amount of about 4% by weight of said composition.

13. The method of claim 12 wherein said ammonia is present in said composition in an amount such that the pH of said composition is about 9.

14. The method of claim 13 wherein said composition is further characterized to include a corrosion inhibitor comprised of a mixture of an alkylpyridine and dibutylthiourea present in said composition in an amount in the range of from about 0.1% to about 0.3% by volume of said composition.

15. An emulsified composition for dissolving deposits containing organic materials and iron sulfide with minimal hydrogen sulfide evolution comprising:

a basic aqueous solution of a chelating agent selected from the group consisting of citric acid, oxalic acid, nitrilotriacetic acid, alkylenepolyamine polyacetic acids and mixtures of said chelating agents, said solution having a pH in the range of from about 8 to about 10;

a liquid hydrocarbon solvent for said organic materials; and an emulsifier selected from the group consisting of oxyalkylated phenols and the carboxylate salts thereof, and castor oil ethoxylated with forty moles of ethylene oxide.

16. The composition of claim 15 wherein said chelating agent is present in said composition in an amount in the range of from about 4% to about 8% by weight of said composition.

17. The composition of claim 16 wherein said liquid hydrocarbon solvent is present in said composition in an amount in the range of from about 10% to about 50% by volume of said composition.

18. The composition of claim 17 wherein said emulsifier is castor oil ethoxylated with forty moles of ethylene oxide and is present in said composition in an amount of from about 0.1% to about 1% by volume of said composition.

19. The composition of claim 15 wherein said chelating agent is nitrilotriacetic acid present in said composition in an amount of about 4% by weight, and said composition contains ammonia in an amount such that said composition has a pH of about 9.

20. The composition of claim 19 wherein said liquid hydrocarbon solvent for said organic materials is heavy aromatic naphtha.

21. The composition of claim 20 wherein said heavy aromatic naphtha is present in said composition in an amount of about 30% by volume of said composition.

22. The composition of claim 21 wherein said emulsifier is castor oil ethoxylated with forty moles of ethylene oxide present in said composition in an amount of about 0.5% by volume of said composition.

23. The composition of claim 15 wherein said chelating agent is ethylenediaminetetraacetic acid present in said composition in an amount of about 4% by weight, and said composition contains ammonia in an amount such that said composition has a pH of about 9.

24. The composition of claim 23 wherein said liquid hydrocarbon solvent for said organic materials is heavy aromatic naphtha.

25. The composition of claim 24 wherein said heavy aromatic naphtha is present in said composition in an amount of about 30% by volume of said composition.

26. The composition of claim 25 wherein said emulsifier is castor oil ethoxylated with forty moles of ethylene oxide present in said composition in an amount of about 0.5% by volume of said composition.

27. The composition of claim 26 which is further characterized to include a corrosion inhibitor comprised of a mixture of an alkylpyridine and dibutylthiourea present in said composition in an amount in the range of from about 0.1% to about 0.2% by volume of said composition.

28. The composition of claim 27 which is further characterized to include benzotriazole coupling agent present in said composition in an amount in the range of from about 0.1% to about 1% by weight of said composition.

29. A method of removing deposits containing iron sulfide from surfaces with minimal hydrogen sulfide evolution comprising contacting said deposits for a period of time sufficient to dissolve said deposits with a composition comprised of a basic aqueous solution of a chelating agent selected from the group consisting of citric acid, oxalic acid, nitrilotriacetic acid, alkylenepolyamine polyacetic acids and mixtures of said chelating agents, said solution having a pH in the range of from about 8 to about 10.

30. The method of claim 29 wherein said chelating agent is nitrilotriacetic acid present in said composition in an amount in the range of from about 4% to about 8% by weight of said composition, and said composition contains ammonia in an amount such that said composition has a pH of about 9.

31. The method of claim 29 wherein said chelating agent is ethylenediaminetetraacetic acid present in said composition in an amount in the range of from about 4% to about 8% by weight of said composition, and said composition contains ammonia in an amount such that the pH of said composition is about 9.

32. The method of claim 29 wherein said composition is further characterized to include a corrosion inhibitor comprised of a mixture of an alkylpyridine and dibutylthiourea present in said composition in an amount in the range of from about 0.05% to about 0.6% by volume of said composition.

33. A method of removing deposits containing iron sulfide from surfaces with minimal hydrogen sulfide evolution comprising circulating a composition at a temperature in the range of from about 200° F. to about 300° F. over said surfaces containing said deposits for a period of time sufficient to dissolve said deposits in said composition, said composition comprising a basic aqueous solution of a chelating agent selected from the group consisting of citric acid, oxalic acid, nitrilotriacetic acid, alkylenepolyamine polyacetic acids and mixtures of said chelating agents, said solution having a pH in the range of from about 8 to about 10.

34. The method of claim 33 wherein said chelating agent is nitrilotriacetic acid present in said composition in an amount in the range of from about 4% to about 8% by weight of said composition and said composition contains ammonia in an amount such that said solution has a pH of about 9.

35. The method of claim 33 wherein said chelating agent is ethylenediaminetetraacetic acid present in said composition in an amount in the range of from about 4% to about 8% by weight of said composition and said composition contains ammonia in an amount such that the pH of said composition is about 9.

36. The method of claim 33 wherein said composition is further characterized to include a corrosion inhibitor comprised of a mixture of an alkylpyridine and dibutylthiourea present in said composition in an amount in the range of from about 0.05% to about 0.6% by volume of said composition.

37. A method of removing deposits containing organic materials and iron sulfide with minimal hydrogen sulfide evolution comprising contacting said deposits for a period of time sufficient to dissolve said deposits with an emulsified composition comprised of:

a basic aqueous solution of a chelating agent selected from the group consisting of citric acid, oxalic acid, nitrilotriacetic acid, alkylenepolyamine polyacetic acids and mixtures of said chelating agents, said solution having a pH in the range of from about 8 to about 10;

a liquid hydrocarbon solvent for said organic materials; and an emulsifier selected from the group consisting of oxyalkylated phenols and the carboxylate salts thereof, and castor oil ethoxylated with forty moles of ethylene oxide.

38. The method of claim 37 wherein said chelating agent is nitrilotriacetic acid present in said composition in an amount in the range of from about 4% to about 8% by weight of said composition, and said composition contains ammonia in an amount such that the pH of said composition is about 9.

39. The method of claim 37 wherein said chelating agent is ethylenediaminetetraacetic acid present in said composition in an amount in the range of from about 4% to about 8% by weight of said composition, and said composition contains ammonia in an amount such that the pH of said composition is about 9.

40. The method of claim 37 wherein said liquid hydrocarbon solvent is selected from the group consisting of ortho-dichlorobenzene, xylene and heavy aromatic naphtha.

41. The method of claim 40 wherein said liquid hydrocarbon solvent is heavy aromatic naphtha present in said composition in an amount in the range of from about 10% to about 50% by volume of said composition.

42. The method of claim 37 wherein said emulsifier is castor oil ethoxylated with forty moles of ethylene oxide present in said composition in an amount in the range of from about 0.1% to about 1% by volume of said composition.

43. The method of claim 37 wherein said composition is further characterized to include a corrosion inhibitor comprised of a mixture of an alkylpyridine and dibutylthiourea present in said composition in an amount in the range of from about 0.05% to about 0.6% by volume of said composition.

44. The method of claim 37 wherein said composition is further characterized to include benzotriazole coupling agent present in said composition in an amount in the range of from about 0.1% to about 1.0% by weight of said composition.

45. The method of claim 37 wherein said chelating agent is ethylenediaminetetraacetic acid present in said composition in an amount of about 4% by weight of said composition, said liquid hydrocarbon solvent is heavy aromatic naphtha present in said composition in an amount of about 30% by volume and said emulsifier is castor oil ethoxylated with forty moles of ethylene oxide present in said composition in an amount of about 0.5% by volume.

46. The method of claim 45 wherein said composition is further characterized to include a corrosion inhibitor comprised of a mixture of an alkylpyridine and dibutylthiourea present in said composition in an amount of about 0.1% by volume and benzotriazole coupling agent present in said composition in an amount of about 0.3% by weight.

47. A method of removing deposits containing organic materials and iron sulfide from surfaces with minimal hydrogen sulfide evolution comprising:

circulating an emulsified composition over said surfaces containing said deposits, said composition being comprised of a basic aqueous solution of ethylenediaminetetraacetic acid chelating agent present in said composition in an amount of about 4% by weight of said composition, heavy aromatic naphtha present in said composition in an amount of about 30% by volume of said composition, castor oil ethoxylated with forty moles of ethylene oxide emulsifier present in said composition in an amount of about 0.5% by volume of said composition, a corrosion inhibitor comprised of a mixture of an alkylpyridine and dibutylthiourea present in said composition in an amount of about 0.1% by volume of said composition and benzotriazole coupling agent present in said composition in an amount of about 0.3% by weight of said composition;

heating said composition to a temperature in the range of from about 200° F. to about 300° F. while said composition is circulating over said surfaces; and withdrawing said composition from said surfaces after said composition has circulated thereover for a period of time sufficient to dissolve said deposits.

* * * * *

UNITED STATES PATENT AND TRADEMARK OFFICE

CERTIFICATE OF CORRECTION

PATENT NO. : 4,276,185

DATED : June 30, 1981

INVENTOR(S) : Larry D. Martin

It is certified that error appears in the above–identified patent and that said Letters Patent are hereby corrected as shown below:

In Column 1, line 35, after the word "binding" insert the word --iron--.

Signed and Sealed this

*Eighth* Day of *September 1981*

[SEAL]

*Attest:*

GERALD J. MOSSINGHOFF

*Attesting Officer*

*Commissioner of Patents and Trademarks*